US006079993A

United States Patent [19]

Laine

[11] Patent Number: 6,079,993

[45] Date of Patent: Jun. 27, 2000

[54] HINGED ELECTRONIC DEVICE

[75] Inventor: Pasi Laine, Tampere, Finland

[73] Assignee: Nokia Mobile Phones Limited, Espoo, Finland

[21] Appl. No.: 09/268,754

[22] Filed: Mar. 16, 1999

[30] Foreign Application Priority Data

Mar. 18, 1998 [FI] Finland ..... 980603

[51] Int. Cl.[7] ..... H01R 3/00

[52] U.S. Cl. ..... 439/165; 16/223

[58] Field of Search ..... 439/165, 31; 364/708; 16/223, 337

[56] References Cited

U.S. PATENT DOCUMENTS

| | | | |
|---|---|---|---|
| 4,571,456 | 2/1986 | Paulsen et al. | 179/2 C |
| 4,825,395 | 4/1989 | Kinser, Jr. et al. | 364/708 |
| 4,959,887 | 10/1990 | Gruenberg et al. | 16/223 |
| 5,141,446 | 8/1992 | Ozouf et al. | 439/165 |
| 5,168,429 | 12/1992 | Hosoi | 439/165 |
| 5,170,494 | 12/1992 | Levanto | 455/90 |
| 5,265,158 | 11/1993 | Tattari | 379/433 |
| 5,433,620 | 7/1995 | Kobayashi | 439/165 |
| 5,606,730 | 2/1997 | Rush et al. | 455/90 |
| 5,642,402 | 6/1997 | Vilmi et al. | 379/58 |
| 5,669,069 | 9/1997 | Rautila | 455/558 |
| 5,779,115 | 7/1998 | Parkas et al. | 224/272 |
| 5,787,341 | 7/1998 | Parkas et al. | 455/90 |

FOREIGN PATENT DOCUMENTS

| | | |
|---|---|---|
| 0777369A2 | 6/1997 | European Pat. Off. . |
| 956225 | 6/1997 | Finland . |
| 06152491A | 5/1994 | Japan . |

*Primary Examiner*—Gary F. Paumen
*Attorney, Agent, or Firm*—Perman & Green, LLP

[57] ABSTRACT

A hinged device comprising a first and a second part joined with hinges. The first and second part have been connected using a cable. The cable exits from the first part through a hole near a hinge in the first part and is guided to run a part of its length along the hinge-axis to the second part using a holding means mounted on top of the hole. When the parts are turned in relation to each other, the cable twists in relation to its longitudinal axis.

10 Claims, 4 Drawing Sheets

PRIOR ART

HINGED ELECTRONIC DEVICE

FIELD OF THE INVENTION

The present invention relates to a hinged electronic device comprising a first part and a second part hinged together, and a cable connecting the first and second part.

BACKGROUND OF THE INVENTION

It is often necessary to connect electrically two components separated by a hinge. In some cases the object sets particular requirements to the device, such as in the case of PDA (Personal Digital Assistent) -type mobile station applications. In order to improve their usability it is common to strive for as small a size as possible and as a result of this desire for miniaturizing are tried to make the housing of a mobile station and its parts as small as possible. If the two parts separated by hinges of a mobile station of a hinged construction comprise components to be connected to each other using conductors, certain problems are met, which problems culminate due to the miniaturizing. The bending radius of a conductor to be threaded through a hinge becomes smaller as the hinge becomes smaller. The cable between the hinged parts is subject to repeated bending. Still the cable should not be chafed, tensioned, nor be bent at too short a stretch in order to not get its cord or isolation damaged. The cable must be sufficiently flexible to tolerate the repeated deformations it is exposed to and it further has to fit in the lead-through reserved for it. In a mobile station, the radio frequency signals of which are transferred from one hinged part to another, a coaxial cable is used for this purpose.

It is prior known from Fl Patent Application 956225 such a hinged device, in which a tubular middle piece has been placed on the hinge axis, through which middle piece the cable runs perpendicularly or obliquely. The arrangement is particularly suitable to be used in PDA -devices for very flexible, flat cable type conductors, and if the diameter of the middle piece is big enough, it can also be used as a coaxial cable lead-through from the base part to the folding part. A coaxial cable does not tolerate bending as well as a cord made of thin copper strands.

It is prior known from U.S. Pat. No. 4,571,456 a portable computer shown in FIGS. 4*a* and 4*b* comprising base part 22 and display unit 23, and cable 24 between the base part and the display unit. Display unit 23 has been arranged to fold in relation to base housing 22 using hinge construction 25. Cable 24 passes through the hinge parallel to the hinge axis. The hinge construction shown in FIG. 4*a* is situated in the edge of the cover of the portable computer and cable 24 has been thread into a groove in the base housing side halve of the hinge and is protected by the part of the portable computer. In a hinge according to the construction, cable 24 is thus enveloped by the hinge section of the display unit and the hinge section is further surrounded by the hinge casing of the portable computer, in which casing said display unit hinge section turns. The hinge construction thus is quite sizable, and particularly if the ends of cable 24 have been provided with pre-mounted connectors and because of these an even larger space has to be left in the middle of the hinge in order to allow to thread a cable end with a connector through the hinge in the assembly stage.

In so called Organiser-type devices it also has been used a hinge construction in which the cable lead-through has been realized perpendicularly to the hinge axis, in which case the bending radius of the cables is small and their bending angle is as big as the unfolding angle of the device.

This may cause stress on the cables and in addition to that some slack must be left in the cables. Increasing the deformation area of the cable decreases the stress and from U.S. Pat. No. 5,141,446 such a solution is known, in which a flat cable has been loosely coiled around an axis inside a tube. The flat cable coils around the axis when the hinge is used, in which case the strain on the flat cable is distributed in the flat cable on one full turn around the axis. The required slack in turn stays inside the tube. The hinge construction according to the patent, however, is largish because between the axis and the tube there must remain room well over the thickness of the flat cable, and in the assembly stage the required slack must be left inside the construction.

SUMMARY OF THE INVENTION

Now such an electronic device has been invented, in which a cable between a first and a second part of the device, the second part being adapted to the former to be folding on a hinge, is supported to run from a hinge-axis between the parts essentially folding in relation to each other essentially parallel to said axis outside the hinge, as a result of which when the device is opened and closed, said cable can avoid being bent by twisting on a section of its length, and in which a cable equipped with pre-mounted connectors can be threaded with its connectors from the first part to the second part.

An electronic device according to the invention comprising

- a first part
- a second part,
- a hinge fixing the first part to the second part, supported by which hinge the first part and the second part have been arranged to turn in relation to each other, and
- a cable running from the first part to the second part wherein the cable comprises
  - a first end fixed to the first part,
  - a first section running inside the first part,
  - a second section, in which the cable runs to the hinge-axis and is bent essentially parallel to the hinge-axis at a certain point on the hinge-axis,
  - a third section, in which the cable runs for a certain length essentially parallel to the hinge-axis, and
  - a second end fixed to the second part, and that the cable is on the hinge-axis outside the hinge.

BRIEF DESCRIPTION OF THE DRAWINGS

The invention is described in detail in the following with reference to enclosed figures, of which

DETAILED DESCRIPTION

Figure 1A:
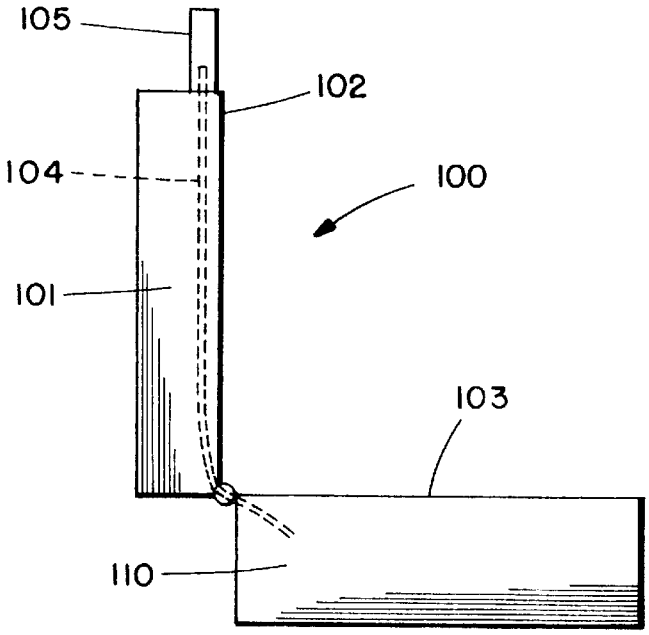
FIG. 1*a* presents an example of a mobile station according to a first aspect of the invention in a side view.

FIG. 1 presents, seen from the end, mobile station 100 according to the invention unfolded 90°, comprising first part 101 and second part 110 hinged to the former. Antenna 105 of the mobile station is situated in the first part and it is connected with antenna cable 104 to the second part, e.g. to a radio circuit in it. The figure further shows cover 102 of the first part and cover 103 of the second part which end up against each other when the mobile station is folded together.

Figure 1B:
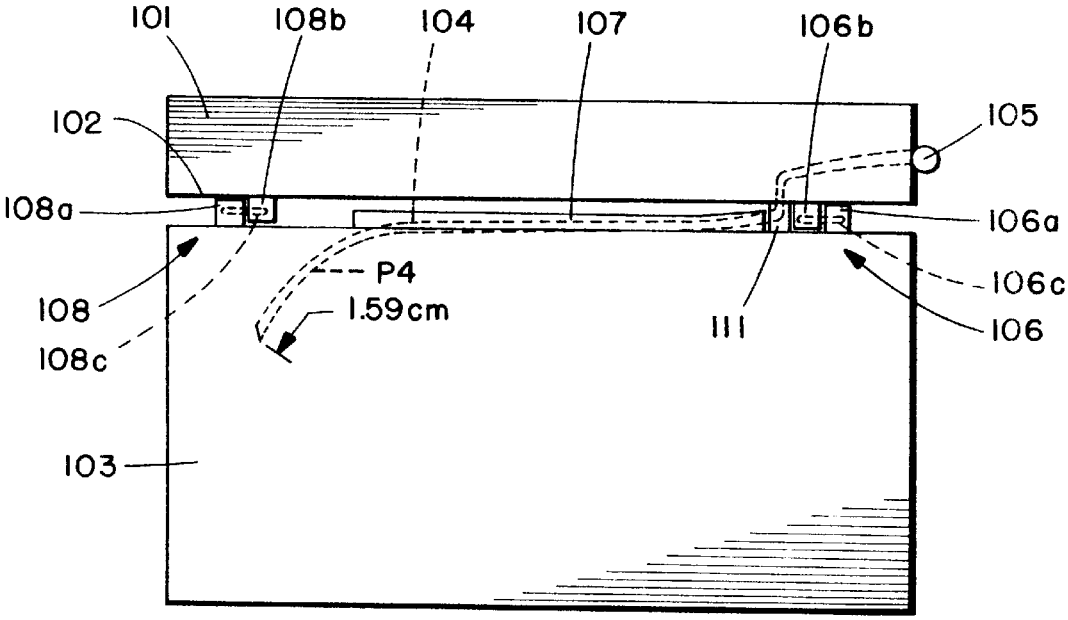
FIG. 1*b* presents an example of the mobile station shown in FIG. 1 in a top view.

FIG. 1*b* presents a mobile station seen from the top in relation to FIG. 1*a*. First hinge 106 and second hinge 108 connect the first and second part of the mobile station. The first hinge comprises hinge part 106*b*, counterpart 106*a* and hinge pin 106*c*. The second hinge comprises hinge part 108*b*, counterpart 108*a* and hinge pin 108*c*. The counter halves of the hinges have been fixed to cover 103 of the second part of the mobile station. Between these, on cover 102 of the first part, hinge part 106*b* has been fixed against counterpart 106*a* and hinge part 108*b* against counterpart 108*a*. Antenna cable 104 has been guided to meet the hinge-axis at a small angle α along spacious conduit 107 formed at the assembly stage between the components comprised in the second part. The conduit can preferably be mainly inside second part 110 protected by cover 103, but it can also be arranged to be partly or entirely between the first and second part, as shown in FIG. 1*b*. Angle α is presented in FIG. 1*c*. In the immediate vicinity of the part leaving the antenna cable on the hinge-axis, adapter piece 111 mounted on the cover of the first part guides the antenna cable from the hinge-axis through opening 202 in cover 102 of the first part in FIG. 2 to first part 101, from where is runs further to antenna 105. The adapter piece prevents the antenna cable from twisting inside it when the mobile station is opened and closed, in which case the antenna cable twists inside conduit 107.

Figure 1C:
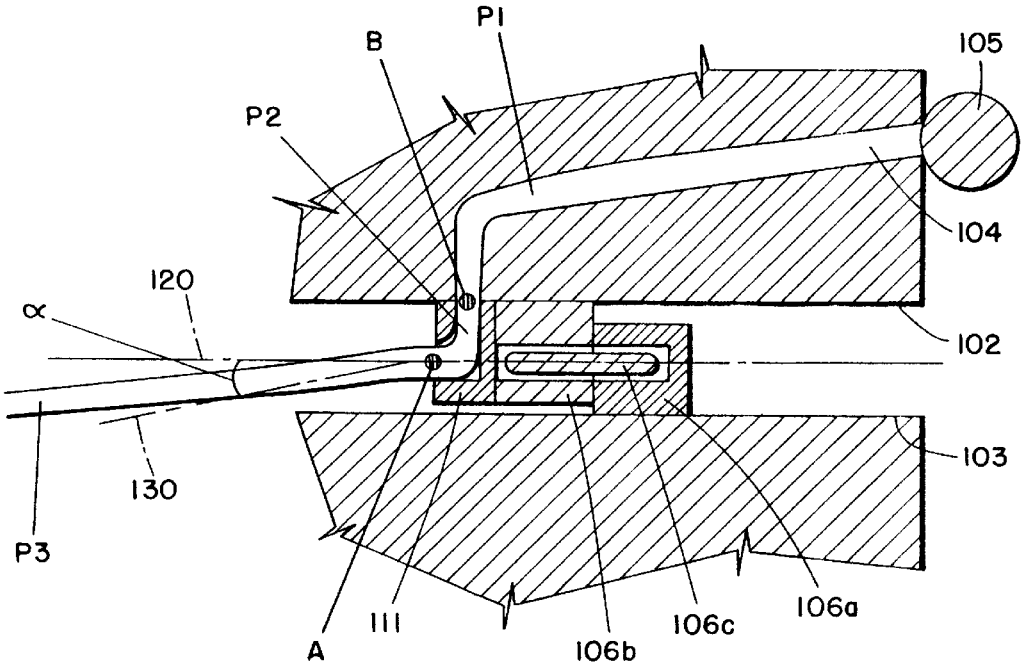
FIG. 1*c* presents the hinge and the cable adapter piece shown in FIG. 1*b* as a section view through the hinge-axis on the plane of the paper.

FIG. 1*c* presents out of FIG. 1*b* the parts comprised in the first hinge, adapter piece 111 and part of antenna cable 104. Hinge part 106*b* has been fixed to cover 102 of the first part and alongside the hinge part there is counterpart 106*a* fixed to cover 103 of the second part. Hinge pin 106*c* is situated inside hinge part 106*a* and counterpart 106*b*. Adapter piece 111 is on the other side of the hinge part. The Figure also shows imaginary hinge-axis 120, around which the first and second part of the mobile station turn in relation to each other, and tangent 130 has been drawn for the antenna cable leaving the hinge-axis. The length of the cable can be divided into four sections P1, P2, P3 and P4. In first section P1 the cable runs from antenna 105 along route P1 to point B in the joining point of the adapter piece and cover 102 of the first part. In second section P2 the cable runs to the hinge-axis to point A guided by the adapter piece, from where it in third section P3 leaves the hinge-axis at angle α and continues for a distance of e.g. 50 times the cable diameter still essentially in the direction of the hinge-axis. The antenna cable turns away from the direction of the hinge-axis in section P4, as shown in FIG. 1*b*. Angle α between the tangent of the antenna cable and the hinge-axis causes on the antenna cable, when the mobile station is opened and closed, a breaking angle having the same direction as angle α when the cable is twisted along its longitudinal axis. The angle has to be dimensioned to be small enough with regard to the elasticity of the antenna cable in such a way that the antenna cable endures the repeated changes of form it is exposed to on the break-zone. Angle α can be for example 20°. A suitable angle can be iterated by testing different angles in stress tests. In tests made on a certain type of coaxial cable it was found out that the number of the sharp changes of opening angle, at a certain angle of over 90°, endured by the cable was for the prototypes of a mobile station according to the invention used over one thousand times the number of sharp bending the cable endured, even though in the prototype the cable was also subjected to a small break-angle.

Conduit 107 shown in FIG. 1*b* can be replaced e.g. by fixing antenna cable 104 to the cover of the second part using spacious supports or by arranging in the second part a spacious tube intended particularly for the antenna cable, as long as angle α is sufficiently small and the tube leaves the antenna cable sufficiently close to hinge-axis 120 and adapter piece 111.

Figure 2:
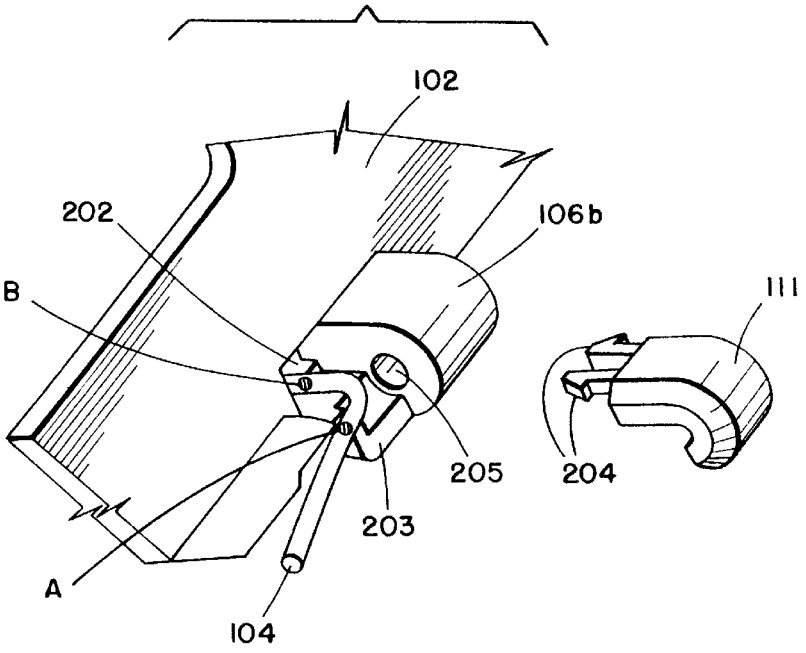
FIG. 2 presents an enlarged view of the area of the hinge section of the housing of the first part of the mobile station shown in FIG. 1*a;*

FIG. 2 presents axonometrically cover 102 of the mobile station and hinge part 106*b* with surroundings, seen from the right in relation to FIG. 1*a*. Next to hinge part 106*b*, on the side of the second hinge, there is protrusion 203 formed on the hinge side edge of cover 102, protruding from the cover to the level of hole 205 reserved for the hinge pin of hinge part 106*b*, which protrusion is limited to the direction of the inner part of the cover to approximately the middle of hole 205. In the base of the protrusion, next to hinge part 106*b*, there is aperture 202 with antenna cable 104 threaded through the aperture. The figure also presents detached adapter piece 111, which has the form of the letter J opening toward cover 102. When pushed to the mouth of opening 202, the adapter piece is fixed to it with its barbs 204 and forms together with protrusion 203 a runway from aperture 202, point B, to the hinge axis in point A, through which runway antenna cable 104 can pass.

Figure 3:
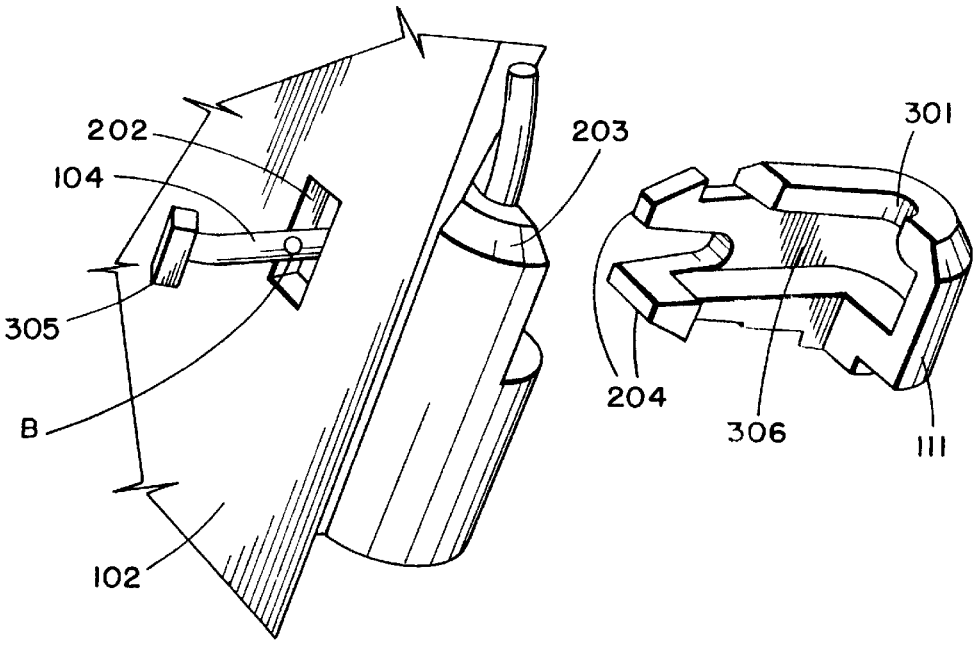
FIG. 3 presents the adapter piece and cable lead-through on the cover of the first part of the mobile station, shown in FIG. 2, seen obliquely from below compared with FIG. 2.
Figure 4A:
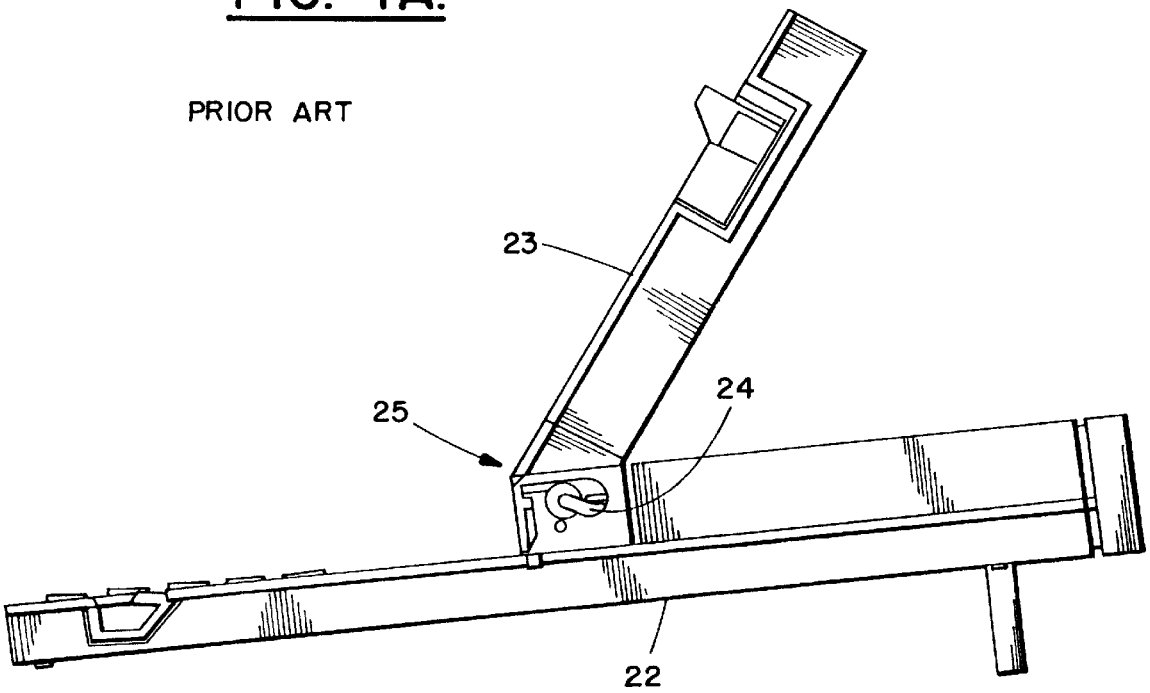
FIG. 4A. PRIOR ART
FIG. 4*a* presents a portable computer according to prior art.
Figure 4B:
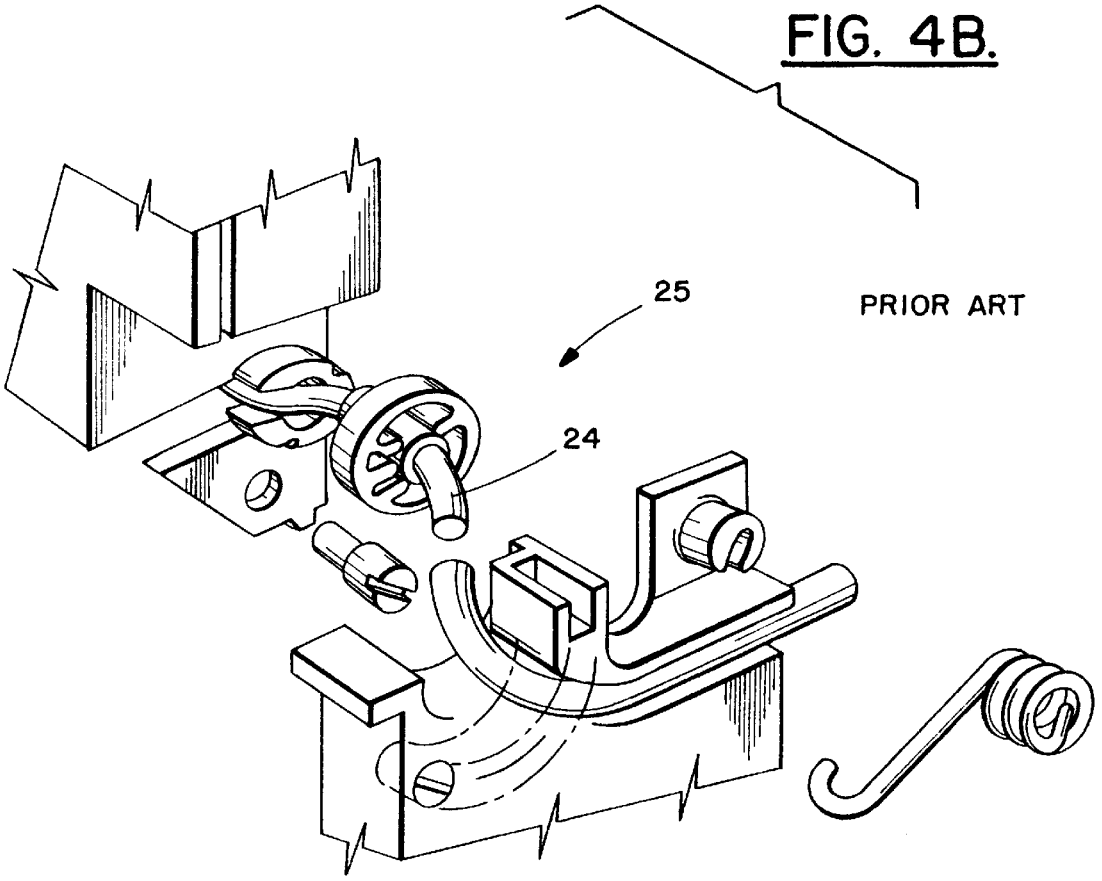
FIG. 4*b* presents the cable lead-through solution of the device shown in FIG. 4*a*.

FIG. 3 presents axonometrically the area shown in FIG. 2 seen obliquely from under cover 102. In adapter piece 111, on the surface opposite to aperture 202, there is central groove 306 which forms a spacious passage for antenna cable 104. Antenna cable 104 and connector 305 at the end of it are in the assembly stage threaded through aperture 202 perpendicularly through cover 102 and the antenna cable is set on protrusion 203. The adapter piece is pressed on the aperture, and the adapter piece locks to it with its barbs 204 whereupon the antenna cable is squeezed on the hinge axis between protrusion 203 and saddle-formed edge 301 formed by the curved inner edge of the adapter piece. Point B at aperture 202 has also been marked on the figure. The squeezing of the antenna cable brings between adapter piece 111 and the antenna cable a friction which prevents antenna cable 104 from twisting in section P2, shown in FIG. 1*c*, of the antenna cable, in which section antenna cable 104 does not run essentially in the direction of the hinge-axis. There squeezing force, however, is low enough not to damage the coaxial cable, nor does friction prevent from e.g. sliding the antenna cable by hand between the adapter piece and the protrusion, which facilitates in the assembly stage the length of the antenna cable remaining in the first part to be adjusted to a suitable length when the adapter piece has been mounted in place. The task of adapter piece 111 is to guide antenna cable 104 to the hinge-axis and adapt it into aperture 202 which is spacious enough to allow also one of antenna cable connectors 305 to pass trough it. The adapter piece can preferably be removed and mounted back to cover 102 in order to enable enlarging the runway of the antenna cable for the service of the mobile station in order to remove the antenna cable undamaged. When in its place, the adapter piece covers aperture 202, hole 205 reserved for the hinge pin of hinge part 106*b* and in an assembled mobile station also hinge pin 106*c* inside the hole.

The preferable location of the lead-through of cable 104 is next to hinge part 106*b*, in which case protrusion 203 and hinge part 106*b* can be integrated into one piece making the manufacturing of the mobile station simpler and at the same strengthen the construction formed. The lead-through can however be realized separate from the hinge between the hinges, as long as it is arranged for the antenna cable a sufficiently long section having the same direction as the hinge-axis in such awat that the cable endures the repeated twisting it is exposed to in this section.

It is also possible to arrange for the antenna cable a tubular intermediate piece, known from Patent Publication Fl-956225, between the hinges, in which case the cable can run from adapter piece 111 to the intermediate piece and through the wall of the intermediate piece inside the second part, in which case the cable can be, in addition to the twisting force, subject to bending of the magnitude of an angle smaller than the unfolding angle of the device.

The connecting of a thin coaxial cable used in the case of a folding mobile station between the two parts is difficult using standard tools. In order to make assembly and maintenance easier, it is possible to use antenna cables with pre-mounted connectors in both ends of the coaxial cable, in which case the cable connectors are connected to mating connectors intended for them. The cable connectors can be mounted centrally using one production tool and the second connectors intended for them can be mounted e.g. using a normal production technology on a printed circuit board during the manufacturing process of the mobile station. Such a cable with connectors can be tested already prior to its assembling in a mobile station. On the other hand, when a cable with connectors is used, the lead-through from one folding part to the other must be arranged in such a way that the cable can be installed, and if required, replaced with its connectors. For the lead-through of a cable with connectors it is required a hole considerably larger than that for cable only.

In a device according to the invention a cable does not pass through two hinge parts, one within the other, turning in relation to each other. For example in a portable computer, prior known from U.S. Pat. No. 4,571,456, the cable has been threaded through a hinge to the hinge-axis, and the hinge consists of two parts, one within the other, surrounding the cable, the first part of which forms a hinge part fixed to the base section of the computer and the second part forms a counterpart turning inside the first part. When a cable is threaded through a hinge on the hinge-axis, the installing of two parts, one within the other and moving in relation to each other, is inevitable, and thus the hinge becomes big in diameter, especially if the center of the hinge has to be made for the size of the connector at the end of the cable and the connector is much bigger than the diameter of the cable. The cable must however be brought from one folding part to the other, supported on the hinge-axis or at least close to it in order to allow it to twist smoothly and in order to that the break-angle should not increase too much when the device is opened or closed. For this purpose a separate adapter piece is used in the present invention. The running of the cable from one hinged part to the other over the hinge axis is preferable for a coaxial cable, because a coaxial cable poorly endures bending if the bending radius is small, for example 2 mm. A cable essentially parallel to the hinge-axis, brought to the hinge-axis in the way of the invention, twists on a stretch essentially longer than the one which can be arranged for a cable crossing the hinge-axis perpendicularly, e.g. on a stretch of 100 mm, in which case also a stiff cable can be made to endure the repeated deformations it is exposed to when an electronic device is repeatedly unfolded and folded when it is used.

A device according to the invention is also suitable for leading an optical cable from one folding part to another, provided that section P3 reserved for the twisting of the cable is sufficiently long in relation to the thickness of the optical cable.

The hinge side of the device can also be closed entirely by extending the edges of covers 102 and 103 to meet on the hinge axis. By designing the matching planes of the edges to be sharp or curved with a suitable curve radius, they do not abut against each other and thus do not prevent the unfolding and folding of the device.

The advantage of a hinged device according to the invention is the compact construction thus formed allowing the use of a cable equipped with pre-mounted connectors connecting the two parts hinged together. Neither is it necessary to leave any play in the assembly stage of the device, because the unfolding and folding of the hinged device do not essentially alter the length of the twisting cable.

A device according to the invention is easy to assemble. When the device is serviced, it is also possible to replace without any special tools cable 104 with a new cable with pre-mounted connectors. The solution according to the invention is relatively quick to manufacture and it is suitable for both serial manufacturing and e.g. in a service shop for manual assembly and dismantling.

The above is a description of the realization of the invention and its embodiments utilizing examples. It is self-evident to a person skilled in the art that the invention is not limited to the details of the examples presented above and that the invention can be realized also in other embodiments without deviating from the characteristics of the invention. The presented embodiments should be regarded as illustrating but not limiting. Thus the possibilities to realize and use the invention are limited only by the enclosed claims. Thus different embodiments of the invention specified by the claims, also equivalent embodiments, are included in the scope of the invention.

What is claimed is:

1. An electronic device comprising a first part, a second part, a hinge fixing the first and the second part to each other, by which hinge the first and second part are supported and arranged to turn in relation to each other, and a cable leading from the first part to the second part, wherein the cable has a first end connected in the first part, a first section running inside the first part, a second section, in which the cable runs to a hinge-axis and is turned essentially parallel to the hinge-axis in a certain point on the hinge-axis, a third section, in which the cable runs essentially parallel with the hinge-axis for a distance, and a second end fixed in the second part, the distance being at least as long as a substantial number of times a diameter of the cable, and that the of the cable is on the hinge-axis outside the hinge.

2. A device according to claim 1, further comprising holding means which keeps the cable in place in relation to the first part and allows the cable to twist in the third section and prevents the cable from twisting in the second section when the first and second part are moved in relation to each other.

3. A device according to claim 1, wherein the first part is enveloped in a first cover, in which there is formed an aperture near the hinge-axis, through which aperture said cable is threaded inside said first part, and the cable comprises a first connector in its first end and a second connector in the other end, and said aperture is larger than the smaller one of said first and second connector.

4. A device according to claim 2, wherein the first part is enveloped in a first cover, in which there is formed an aperture near the hinge-axis, through which aperture said cable is threaded inside said first part, and the cable comprises a first connector in its first end and a second connector in the other end, and said aperture is larger than the smaller one of said first and second connector and said second part has a protrusion, and holding means which presses, when mounted in place, the cable against the protrusion preventing the cable from twisting in said second section of the cable, and the holding means and the protrusion guide the cable in said point essentially parallel to the hinge axis.

5. A device according to claim 1, wherein said second part comprises a space reserved for the cable, the third section of which cable is situated essentially in said space, and said space is spacious enough to allow the cable to twist inside it when the first part is moved in relation to the second part.

6. A device according to claim 1, wherein in said third section of the cable the cable leaves the hinge-axis gently at a certain angle ($\alpha$) and runs essentially in a straight line.

7. A device according to claim 1, wherein said cable comprises a fourth section continuing from its third section, in which fourth section the cable turns essentially away from the direction of the hinge-axis.

8. A device according to claim 1, wherein the device comprises two hinges and the cable has been guided to the hinge-axis in the area between the hinges.

9. A device according to claim 1, wherein said cable is a coaxial cable.

10. A device according to claim 1, wherein the device is a mobile station.

* * * * *

UNITED STATES PATENT AND TRADEMARK OFFICE

CERTIFICATE OF CORRECTION

PATENT NO. : 6,079,993
APPLICATION NO. : 09/268754
DATED : June 27, 2000
INVENTOR(S) : Pasi Laine It is certified that error appears in the above-identified patent and that said Letters Patent is hereby corrected as shown below:

Column 6, line 60, in Claim 1, before "of" insert --third section--

Signed and Sealed this

Thirtieth Day of November, 2010

David J. Kappos

David J. Kappos
*Director of the United States Patent and Trademark Office*